United States Patent [19]

Romanin

[11] 4,027,704

[45] June 7, 1977

[54] METHOD AND DEVICE FOR DUMMY SHUTTLE OPERATION ON CONVENTIONAL SHUTTLE LOOMS

[75] Inventor: Bruno Romanin, Milan, Italy

[73] Assignee: Campagnie des Brevets et Applications Industrielles Etablissement, Liechtenstein

[22] Filed: Nov. 7, 1975

[21] Appl. No.: 630,026

Related U.S. Application Data

[63] Continuation-in-part of Ser. No. 480,105, June 17, 1974, abandoned.

[30] Foreign Application Priority Data

July 6, 1973 Italy ..... 26285/73
Mar. 25, 1974 Italy ..... 8408/74

[52] U.S. Cl. ..... 139/438; 139/196.2
[51] Int. Cl.[2] ..... D03D 47/24
[58] Field of Search ..... 139/122 R, 122 H, 123, 139/124 R, 125, 126, 437, 438, 439, 450, 196.2

[56] References Cited

UNITED STATES PATENTS

| | | | |
|---|---|---|---|
| 635,198 | 10/1899 | Smith | 139/125 |
| 948,945 | 2/1910 | Smith | 139/125 |
| 2,203,190 | 6/1940 | Gezelle | 139/126 |
| 2,413,155 | 12/1946 | Rickelmann | 139/126 |
| 2,652,860 | 9/1953 | Barzaghi | 139/126 |
| 3,498,338 | 3/1970 | Lutz | 139/126 |
| 3,554,240 | 1/1971 | Sakamoto | 139/125 |
| 3,669,156 | 6/1972 | Porter | 139/125 |
| 3,851,677 | 12/1974 | Rossborg | 139/125 |

*Primary Examiner*—Henry S. Jaudon
*Attorney, Agent, or Firm*—McGlew and Tuttle

[57] ABSTRACT

The method and device convert conventional shuttle looms into dummy shuttle looms, wherein weft yarns, unwound from stationary bobbins or the like outside the loom, are seized, pulled across the warp yarn shed and then released, by means of a so called dummy shuttle or weft gripper, at adjustably selected points along a dummy shuttle path extending along the loom slay, independently of the slay instantaneous position and movement direction. The slay motions and direction changes are utilized to selectively operate weft yarn bearers and weft gripper opening mechanisms for seizing the weft yarns and releasing the same, respectively, at the inlet and at the outlet of the dummy shuttle path across the shed.

4 Claims, 15 Drawing Figures

34"
0'
80
70
18
58
N
68
54
56
60
52
10
0"
Fη
50

34'
N
0'
68
30
58
Z
Z
54
56
66
18
52
0"
Fη
50
10

VI
VII l
54
X
30
58
56
M
96"
IX
M
IX
96
VI
64
68
60
VII
52
62
Fη

58
68
Fη
80
70
X
Z
Z
66
64
60
62

90
S'
36"
90'
90"
93
88
R
34"
94
D'
80
82
92
91
86
84
70
18
Fη
10

Sr
S"
36"
90"
90
88
90'
94
92
A
80
D"
91
93
34"
82
86
84
70
18
Fη
10

METHOD AND DEVICE FOR DUMMY SHUTTLE OPERATION ON CONVENTIONAL SHUTTLE LOOMS

CROSS-REFERENCES TO RELATED APPLICATIONS

This application is a continuation-in-part of my prior application Ser. No. 480,105, filed June 17, 1974, now abandoned.

BACKGROUND OF THE INVENTION

This invention relates to a method and means for carrying out, by relatively simple and inexpensive operations, a conversion of conventional looms, of the type having a weft inserting shuttle, into looms wherein the weft is formed by alternately taking weft yarns from bobbins, spools or the like, fitted in stationary positions on opposite sides of the loom and by pulling the weft yarns across the shed. In such looms, the conventional shuttle is replaced by a so called "weft gripper" or "dummy shuttle", adapted to alternately engage the weft yarns on opposite sides of the loom, pull a suitable length thereof across the shed, leave the yarn end at the shed end, and then repeat the same operations in the opposite loom direction with a weft yarn length unwound from the opposite yarn source.

As is well known, it has been already proposed to replace the conventional weaving methods, wherein the shuttle carries a weft spool wherefrom the weft yarn is progressively unwound and inserted in either direction into the shed, with so called "dummy shuttle" or "weft gripper" methods. Also well known are the advantages due to the elimination of a shuttle weft spool, which unavoidably runs-out in a very short time. However, none of the different attempts and structural solutions heretofore proposed and carried out have led to really satisfactory results, such as to overcome the traditional weaving procedures. One of the greatest drawbacks of known dummy shuttle looms consists in the difficulty to correctly synchronize the different functions of the dummy shuttle with the cyclic motions of all other movable componets of the loom, and in particular with the slay motions. Accordingly, many changes and adaptations in the loom structure and conventional mechanisms were tried by those skilled in the art. The known dummy shuttle looms that presently show acceptable performances practically comprise mechanisms, and follow operating cycles and sequences, that differ sharply from those of conventional looms, and the conversion of already existing shuttle looms into dummy shuttle or weft gripper looms requires, when possible, such a substitution and modification of loom structural and mechanical components as to make the conversion economically not expedient. Further, a desirable efficiency, throughput and plant yield cannot be attained.

SUMMARY OF THE INVENTION

An object of this invention is to provide a method for supplying weft yarn in conventional shuttle looms according to a dummy shuttle operation, as well as a device for carrying out the method, wherein no important changes are required in the conventional shuttle looms to operate the same according to the dummy shuttle method. This advantageous result is obtained by means of so called "weft grippers" that are fitted within the loom shuttle and are designed to alternately seize the weft yarn, that is unwound from two bobbins or the like at opposite sides of the loom, the seizing action being carried out in cooperation with suitable weft bearer elements that are secured to the slay reed and that therefore follow the slay motions. The shuttle, that operates as a dummy shuttle, is formed with a slot, channel, or passage extending in the shuttle lengthwise direction, i.e. in the direction of the dummy shuttle reciprocating movement across the shed, in order to allow the bearer elements to pass through the shuttle body and cause the weft yarns to be engaged by the weft grippers. The method also assures that the yarn lengths, alternately pulled across the shed, be cyclically left free so to obtain a proper sequence of yarn seizing and releasing operations, respectively at the start and at the end of the dummy shuttle path across the shed, independently of the actual position of the slay unit, as the bearer elements and suitable weft gripper opening mechanisms are secured to the reed and follow the slay motions.

This invention also relates to specific technical solutions adapted to allow an efficient conversion of conventional shuttle looms into dummy shuttle or weft gripper looms, these technical solutions essentially carrying out the method of seizing, pulling and then releasing the weft yarns, unwound from stationary bobbins or the like, outside the loom at points along the dummy shuttle path along the slay, independently of the slay instantaneous position and movement direction in respect to loom stationary components, as well as of exploiting the slay position and cyclic direction changes for selectively operating the weft yarn bearers and gripper opening mechanisms at the inlet of the dummy shuttle into the shed and, respectively, at the outlet of the same shuttle from the shed, independently of the dummy shuttle direction across the shed.

According to a further advantageous feature of the method and means, as will be disclosed in greater detail later on, a dummy shuttle is utilized in association with conventional, already operating slay units, without any functional change in the shuttle picking modalities and times in synchronism with the slay oscillating motion, as well as in the shuttle braking and stopping operations that are carried out into already existing boxes on opposite sides of the slay unit.

According to a further feature of this invention, the weft yarn bearers, as well as means to actuate the grippers for releasing the weft yarns at the shed outlet, are assembled on components of the slay unit and, in particular, on the reed or the related reed cap (when present), in such a manner as to allow for a longitudinal adjustment and locking thereof in suitable positions along the slay and near to the shed ends, in order to ensure a loom use and a correct fabric formation even when the fabric width is smaller than the maximum width as allowed by the loom sizes. Accordingly, the device operating sequence and times are in agreement with the actual shed width and the actual time as taken by the dummy shuttle to travel therethrough, independently of the constant length of the dummy shuttle path between the conventional shuttle boxes at opposite ends of the slay.

DESCRIPTION OF PREFERRED EMBODIMENTS

Figure 1:
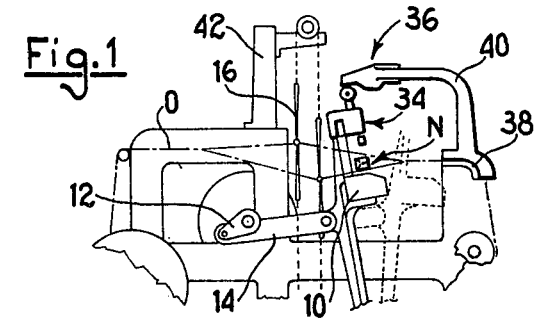
FIG. 1 is a side view with parts in section, diagrammatically showing the upper portion of a conventional shuttle loom, without already well known auxiliary details and components, and wherein devices according to this invention to allow for a conversion into a dummy shuttle loom are illustrated.

For a better understanding of the present invention, a brief description of the main components and operations of a conventional shuttle loom will be given with reference to FIGS. 1 to 4. Such conventional shuttle looms typically comprise a slay 10 that is cyclically swung about a horizontal axis (not shown) by means of a known linkwork comprising a crankshaft 12, and one or generally a plurality of connecting rods 14 (see FIG. 1). The slay oscillatory movement is usually referred to in terms of crankshaft rotation, and its forward and backward end-stroke positions A and R, respectively (FIGS. 2 and 4), are therefore coincident with the top and bottom dead centers of the linkwork, at the end of each 180° rotation of crankshaft 12.

In conventional looms, the slay oscillating motion A-R and vice-versa occurs without any interruption at the direction reversal points and, in the positive and negative accelerations of the swinging assembly, as a trigonometrical function of the rotary motion of crankshaft 12. Concurrently with the slay oscillations, a known heald assembly 16 (FIG. 1) controls the required motions of warp yarns 0 in order to cyclically form a so called shed P, through which the shuttle is caused to travel. The conventional shuttle overall dimensions are indicated by dash lines N in FIG. 2. As already well known, shed P is formed between warp yarns that extend through the reed 18 and are cyclically and alternately brought into upper and lower coplanar positions 0′ and 0″, converging in the weft beating-up line B, wherefrom the fabric T is formed. The beating-up line is defined by the reed forward end stroke position, as shown by 10*a* in FIG. 2.

Figure 2:
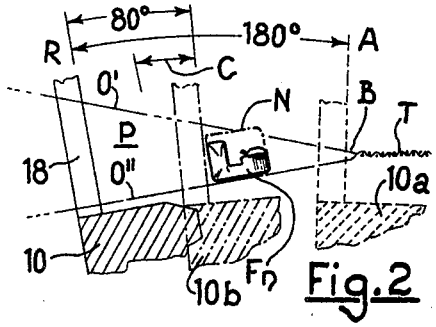
FIG. 2 is a diagrammatic view, in an enlarged scale, of the loom slay upper section in different slay positions, as cyclically assumed during the operation thereof, to illustrate some critical actuating conditions of the present invention.
Figure 3:
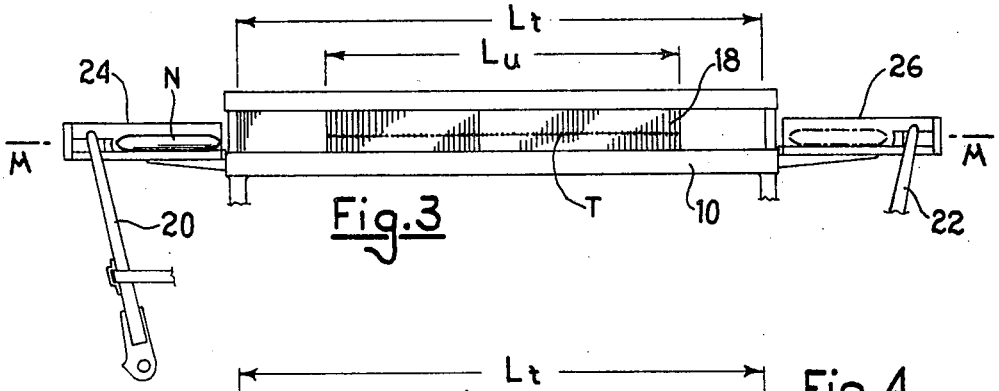
FIG. 3 is a diagrammatic front elevation view of the loom slay, along with known means for alternately picking the shuttle in opposite directions, these means being able to be used, without any change, for picking a dummy shuttle according to this invention.
Figure 4:
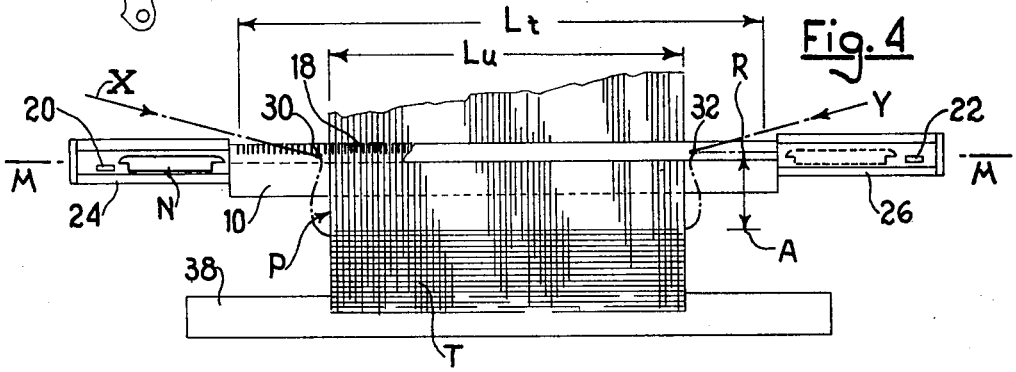
FIG. 4 is a diagrammatic plan view of the slay unit, along with stationary components of the loom, to further illustrate the critical conditions.

Obviously, the shuttle N can travel across the shed P only when this latter is widely open and only at a sufficient distance from the beating-up line B, in order to have a sufficient space between the upper set of warp yarns 0! and the lower set of warp yarns 0″ to allow the shuttle movement therebetween without, or at the most with a slight, grazing on the warp yarn upper set. The most advanced position that can be attained by the slay 10 at the time of the shuttle picking is shown by 10*b* in FIG. 2. Therefore, the available time for the shuttle travel across the shed P is coincident with the time period wherein the slay is swung from position 10*b* to its backward end stroke position and vice-versa. It may be assumed that, in conventional looms, the shuttle picking time is approximately equal to a crankshaft rotation of about 160°–180°, or, otherwise stated, of about 80° before and after the crankshaft rear dead center (FIG. 2). The shuttle picking motion is obtained by means of picking sticks 20, 22 and between end boxes 24, 26 (FIG. 3) that are well known components of the assembly which is swung together with the slay. As well known, the shuttle travels across the shed P during the slay motions and this occurrence is not considered as a drawback, but on the contrary as an advantageous condition due to a better shuttle support on the reed at the shuttle stroke ends (while the reed is accomplishing a forward movement), and also due to the attainment of continuous rotary and swinging motions.

Figure 5:
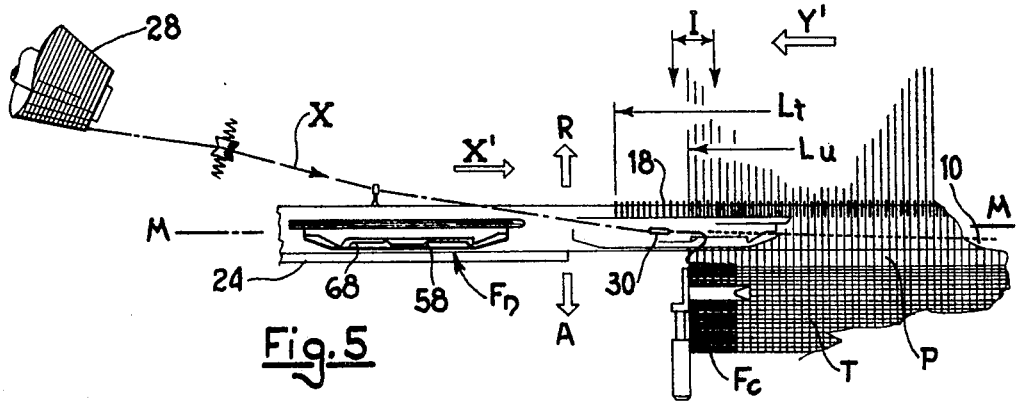
FIG. 5 is a more detailed view showing one slay side (the opposite side being symmetrically similar) that is associated with components of the device according to this invention.

The length of shuttle reciprocating path is constant and depends on the loom overall width, i.e. on the distance between boxes 24, 26. This distance corresponds to the loom maximum width $L_t$ or to the woven fabric maximum width, and is equal to the length of reed 18. However, as well known, such maximum width is not always wholly utilized, when fabrics T having a width smaller than that available are to be woven, as shown by way of example in FIGS. 3 to 5, wherein a fabric having a width $L_u$ is woven. In this case the actual time taken by the shuttle N for travelling across the shed P is shorter and the angle C in FIG. 2 shows the approximate range within which the shuttle travel phase across the shed may vary during a complete slay swinging motion.

Moreover, it is considered as advantageous to use shuttles N having an essentially rectangular cross-section, or at any rate having sufficiently high planar and parallel side faces to exert thereon a friction braking force at the shuttle inlet within either boxes 24, 26, in order to at least greatly reduce the very high shuttle speed.

Any modification of a conventional shuttle loom that does not comply with one or more of the above stated structural and operative conditions and relations obviously involves the necessity to materially change the loom structure and/or main mechanisms. In any case, the weft yarn should be properly inserted only on the useful width $L_u$, as required in each case of weaving a desired fabric T.

According to this invention, a conventional shuttle loom such as just described can be converted, or, more exactly, modified, to operate according to already known "dummy shuttle" or "weft gripper" systems, wherein weft yarns, e.g. unwound from bobbins 28 (one only being shown in FIG. 5), are alternately seized at opposite sides of the loom and inserted into the shed from opposite directions X and Y (FIG. 4), the loom conversion being carried out without any change in the described loom structural components and operating conditions, and with correct formation of a selvedge F*c* on both fabric edges, i.e. in points coincident with the ends of useful fabric width $L_u$.

The device according to this invention comprises a dummy shuttle $F_n$ adapted to be merely substituted for the conventional shuttle N and to be picked and braked between the conventional shuttle boxes 24 and 26 by the already existing means, shuttle F*n* being able to grip, pull and then release the weft yarns at any point along the shuttle path M-M. The device further comprises bearer means 30 and 32 which can be positioned along the shuttle path M-M at points near shed P in accordance with the useful width L*u*, within practical limits. Controlled gripper opening means are provided to operate the seizing means or "weft grippers" carried by shuttle F*n* at points along path M-M which are in preset positions with respect to the ends of shed P. The bearer means and opening means are included in suitable mechanisms generally indicated at 34 mounted on the slay assembly, as on the reed 18, to follow the slay oscillation A-R, and the mechanisms 34 cooperate with control means generally indicated at 36 and which are mounted on a stationary structural component of the loom, such as the loom bank 38, to operate the bearer and opening means cyclically and alternately. Thus, the device of the invention is operated responsive to the relative motion between the slay and the stationary structure of the loom, to cyclically and alternately operate the bearer and opening means. This operation can be carried out at any set time within the time interval defined by the angle C, and the alternating control of the bearer and the opening means, respectively at the inlet of the dummy shuttle F*n* into shed P and the outlet of the dummy shuttle therefrom, may be selected in accordance with the direction of the slay return stroke R and, respectively, the slay forward stroke A.

Figure 12:
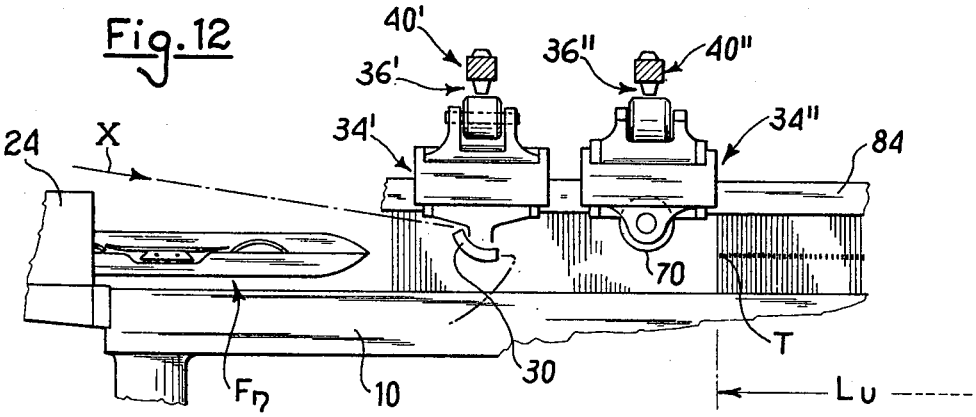
FIG. 12 is a fragmentary enlarged front view of the lefthand portion of the slay assembly of FIG. 3 and of the gripper opener and weft yarn bearer actuators associated thereto.

Each mechanism 34 can comprise a unique body including both one bearer means and one opening means. It is however preferred, for better adjustment purposes, to provide individual mechanisms, such as indicated at 34' and 34'' in FIG. 12 at the lefthand side part of the reed, externally of the selected useful width L*u*, each mechanism being actuated by a correspondingly positioned control means 36' and 36'', supported by structures 40' and 40'' adjustably secured to the loom bank 38, a pair of these components being symmetrically located also at the righthand part of the slay reed (not shown).

Mechanism 34 can be mounted on a slay assembly component, in particular on the reed 18 or the reed cap, by means of clamps, set screws, or the like, preferably with guides and/or grooves extending in the slay longitudinal direction, that allow selective positioning of the weft yarn bearers and gripper opening means along the dummy shuttle path M-M, according to the woven fabric width, i.e. the actually used loom width L*u*. Accordingly, the weft yarn gripping and release times may be in a pre-established positional relationship with the woven fabric edges in order to ensure a correct formation of a selvedge F*c*. The selvedge is obtained in a well known manner, as the weft yarn, then engaged by a weft gripper at the shed inlet, has a length still connected with the last-but-one previously inserted weft yarn (during the previous dummy shuttle stroke in the same direction) that is folded into the shed and then cut, at a pre-established length, by already known suitable cutting means as carried by the dummy shuttle. The gripper opening means operate the weft gripper at a predetermined position and in a manner such that the controlling action opening the weft gripper, which is necessarily exerted from a point outside the shed, leaves free the end of the weft yarn pulled by the dummy shuttle at a point inside the shed, that is, with a slight and predetermined advance with respect to the instant where the left yarn end is pulled beyond the loom useful width L*u* and thus beyond the fabric edge.

It has been determined that this advance is of great importance in assuring that the weft yarn, thus picked and released, is afterwards correctly inserted in the selvedge F*c* that is formed. For instance, assuming that the dummy shuttle is travelling in the direction Y', the distance between the point wherein the weft gripper is acted upon by the opening means, outside of shed P, and the point wherein the weft yarn is disengaged from the same gripper, inside of same shed, is shown by I in FIG. 5 (and similarly in FIG. 8).

The control means generally indicated at 36 are secured to the loom frame, preferably to loom bank 38, by suitable means allowing for selective positioning of the control means. Thus, FIG. 1 illustrates control means 36 mounted on loom bank 38 by arms 40. However, control means 36 could be secured on other structural components of the loom, such as on the upper components 42.

Figure 7:
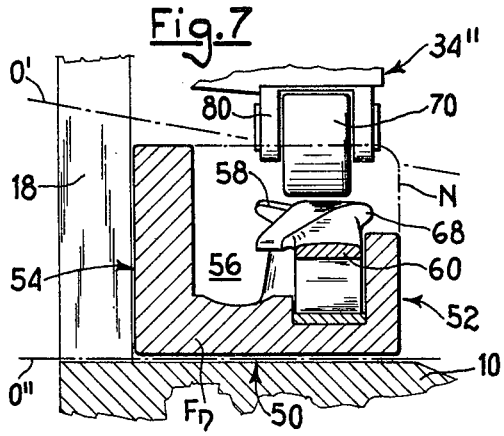
FIGS. 6 and 7 are end elevation views, partly in section, of a dummy shuttle embodying the invention and illustrating means designed to cooperate therewith, taken, respectively, along the lines VI—VI and VII—VII of FIG. 8.
Figure 6:
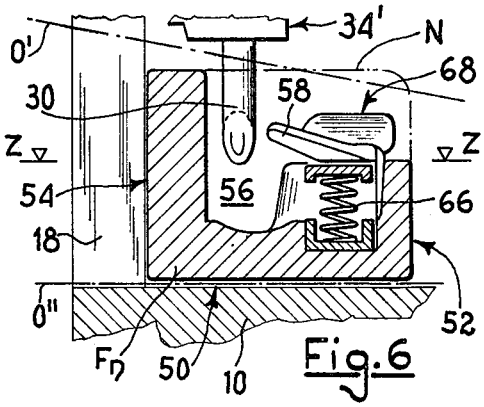

The device typically comprises a particular dummy shuttle, essentially showing the features that will be described with reference to FIGS. 6 to 9. In FIGS. 6 and 7, N indicates the overall contour of a conventional shuttle cross-section acting on the loom to be converted. The dummy shuttle F*n* has a cross-section overall contour that can be inscribed within the contour N of the conventional shuttle N to be replaced, and in particular coinciding therewith at the lower planar side 50, as well as in at least a part of the planar sides 52 and 54, so that dummy shuttle F*n* can be correctly received in already existing loom shuttle boxes 24, 26 and picked therefrom, and can be also braked by already existing braking means acting on the shuttle side surfaces.

Figure 8:
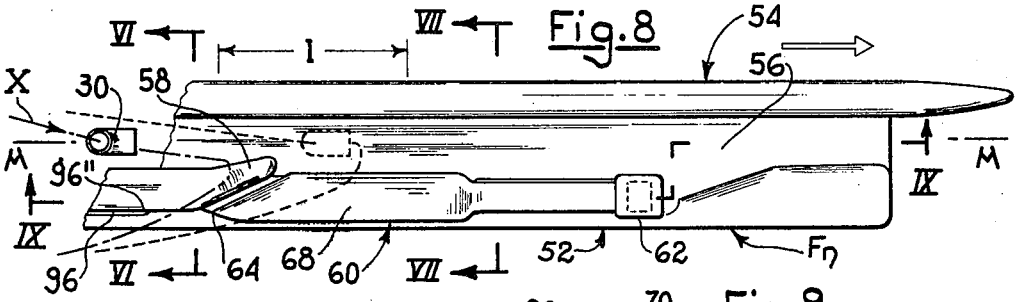
FIG. 8 is a plan view of one dummy shuttle end portion (the other end portion being symmetrically similar) according to a preferred embodiment thereof.
Figure 9:
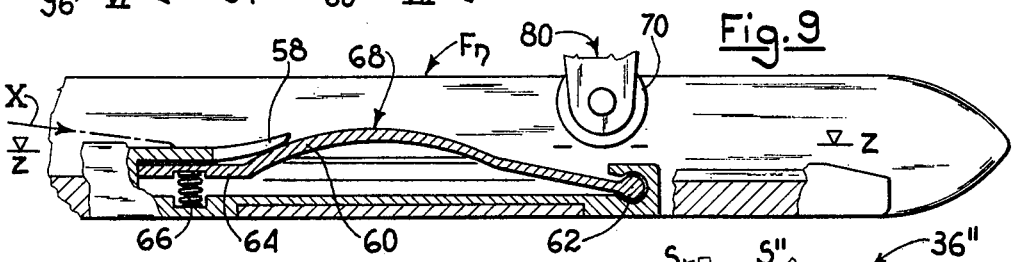
FIG. 9 is a longitudinal section of such dummy shuttle portion, taken along the line IX—IX of FIG. 8.

The dummy shuttle has suitable recesses extending throughout the whole dummy shuttle length, preferably in the form of a longitudinally extending channel 56, that can be freely run through by the end of bearer means 30 (which is in the form of a tubular yarn guide or other equivalent device) in order to locate the weft yarn to be seized at a level —as shown by Z-Z in FIGS. 6 and 9— within the overall cross-sectional contour and wherein the weft yarn may be brought into engagement with suitably shaped gripper ends 58 when the dummy shuttle is running past the yarn, the grippers lying within cross-sectional contour N. FIG. 8 diagrammatically shows the weft yarn seizing step, at two subsequent, very close times, at the start of the selvedge formation.

Two weft yarn grippers are mounted, in symmetrically opposite relationship, on respective symmetrical halves of the dummy shuttle (one only of such halves is fragmentarily shown in FIGS. 8 and 9). Each weft gripper may comprise a swinging or flexible arm 60, that is connected as at 62 to the dummy shuttle structure and has a swinging gripper end 64, which is biased by an elastic means 66 against a correspondingly shaped stationary counterportion 58. Gripper arm 60 has a projecting portion 68, or is mechanically connected with a component having such a projecting portion, so that when the dummy shuttle runs under a control element, as e.g. a roller 70 or a suitably shaped shoe associated with a mechanism 34, as described in greater detail later on, the gripper is forcibly opened and releases the pulled weft yarn. Also these latter components of the weft yarn gripper all lie within the overall cross-sectional contour N of a conventional shuttle which is to be replaced in order to convert the loom according to this invention. Obviously, other structural solutions for performing the weft yarn gripping and subsequent releasing operations may be foreseen, provided that the previously stated conditions be complied with.

Figure 13:
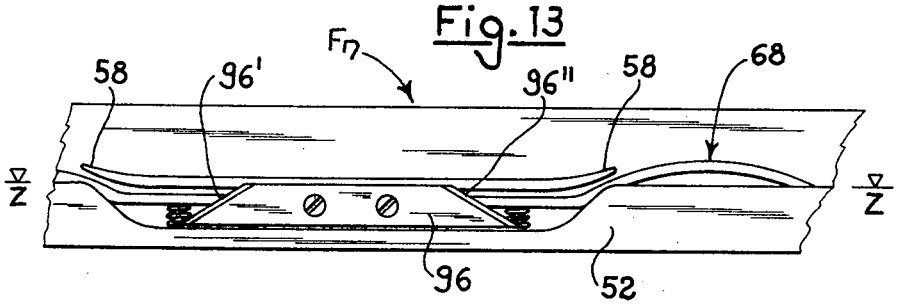
FIG. 13 is a fragmentary side view of the dummy shuttle of FIGS. 6 and 7, and illustrates the center portion of said shuttle wherein the yarn cutter means are located.

The dummy shuttle F*n* comprises further conventional weft yarn cutter means. Such means preferably consist of a cutter steel blade 96 (FIG. 13) having symmetrical sharpened slanting cutting edges 96' and 96'' to provide the necessary cutting actions in both directions of the shuttle reciprocation, as known in the art. Blade 96 is replaceably secured to the shuttle body by means of screws, for example, as shown.

As previously mentioned, the mechanisms and operating cycle of conventional shuttle looms remain unchanged, while the oscillating movement of the slay 10 and the reciprocation of shuttle F*n* are utilized to actuate the various parts of the invention device, this oscillation taking place in the directions A and R. The relative motion between the slay and the loom stationary structure is utilized to cyclically and selectively lower the yarn guide bearers 30 and control members 70, in conjunction with the shuttle reciprocation, in order to bring the related weft yarn in an engagement position with weft gripper component 58 and respectively act on gripper projection 68. However, as can be readily appreciated, the bearers and control members must be activated, i.e. lowered, in the positions as shown in FIGS. 6 and 7, respectively, while the dummy shuttle is just going into and, respectively, out of the shed. These two steps essentially correspond to the same slay spatial position, at a point within angle C of FIG. 2.

To obtain the advance, i.e. interval I, between the weft gripper opening control device operating point and the point wherein the weft yarn is released, since a short yarn length is folded-up within the gripper as diagrammatically shown in FIG. 8, projection 68 is formed —as shown by way of example in FIGS. 8 and 9— on a component directly or indirectly connected with the gripper end 64 and lying at a position which, when viewed in the direction of dummy shuttle movement, is advanced relative to gripper end 64. Thus, the weft yarn is released just where the selvedge is being formed, by mechanical means or the like acting on the weft gripper and which are located outside the shed. For instance, the interval between the weft gripper operating point and the point wherein the gripper is really opened to release the yarn is shown as I in FIG. 8.

To selectively operate the bearer and gripper opening means, different control devices, e.g. electromagnetic or electromechanic control devices, may be used and may be activated by suitable contactors in synchronism with the dummy shuttle and slay movements. However, mechanical means, e.g. of the type as shown in FIGS. 10, 11, 14 and 15, are preferably used.

Mechanisms 34 (only one of which is shown to cylically and selectively lower the gripper opening roller 70) comprise a frame structure 80, suitably assembled and slidingly guided up and down in a mechanism body 82, fastened to the upper rod 84 of reed 18, or of a reed cap, in a position suitably selected according to the desired fabric useful width L*u*. These mechanisms can be made fast to the reed by any suitable means. preferably, and as shown in greater detail in FIG. 14, the body 82 of the mechanisms can be grooved to accomodate the reed cap bar 84 and pressure bolts 98 are provided for securing the mechanisms in any selectively desired position lengthwise of the slay assembly.

Similarly, the control means, generally indicated at 36, can be adjustably secured in the necessary position lengthwise of the structure of the loom. According to the complete embodiment of FIG. 12, each actuator 34' and 34'' is associated to its own control means 36' and 36'', respectively, which are obviously positioned for properly engaging the respectively controlled actuator.

The frame structure 80 carrying gripper opening roller (or shoe) 70 is biased upwardly by suitable resilient means 86 toward the inoperative position of roller 70, while roller 70 is cyclically forced downwardly by a counteracting member, e.g. a further roller 88, that cooperates with a cam 90 on the stationary control means 36. A mechanical system responsive to the action of cam 90 only when the slay is moved in a given direction (in the direction A for controlling a gripper opener, and in the opposite direction for controlling a bearer 30) may be provided to obtain the required operative selection.

A mechanical system 34'' provided for controlling a gripper opener will be now described with reference to FIGS. 10, 11, 14 and 15.

The mechanical system comprises an arm 92 carrying roller 88 and adapted to oscillate about a pivot 91 in frame structure 80 in the direction D' when roller 88 engages the slanting cam lobe 90' so that a thrust S' is swinging direction D' is thereby applied to roller 88. Therefore the frame structure 80 carrying gripper opening roller 70 is not lowered during the slay movement in the direction R. On The contrary, when the slay is swung in the forward direction A (that is coincident with the dummy shuttle going out from the shed), the roller 88 engages the opposite cam lobe 90'' and a thrust in the direction S'' is exerted thereon. However, since arm 92 is prevented from swinging in the opposite direction D'' by engagement of its face 93 with a suitable mechanical retainer or abutment 94 formed in frame structure 80, a resulting force S*r* (FIG. 10) is applied to the roller 88, forcing downwardly the frame structure 80 and the gripper opener 70 before the engagement thereof with the weft gripper projection 68, with a suitable advance relative to the dummy shuttle travel under roller 70.

Figure 11:
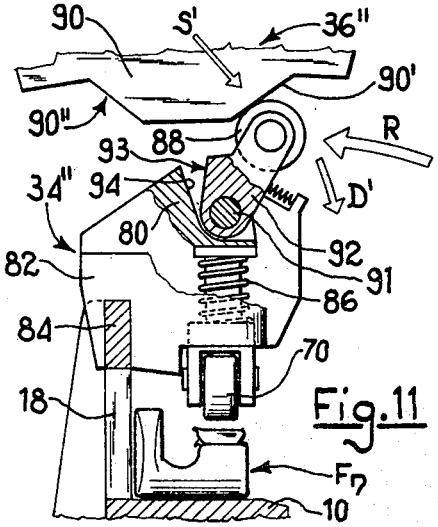
FIGS. 10 and 11 are front views with parts in section in the plane indicated at X—X in FIG. 15 and without some merely structural details, showing a preferred embodiment of a device designed to cyclically and selectively operate the gripper opener (and similarly the weft yarn bearer) at a required time and position, as a function of the instantaneous positions of the dummy shuttle and slay.
Figure 10:
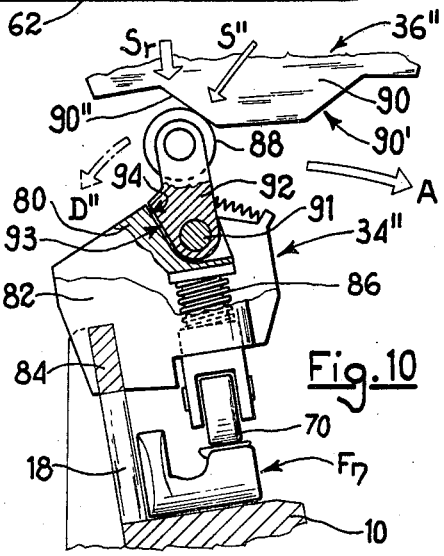
Figure 14:
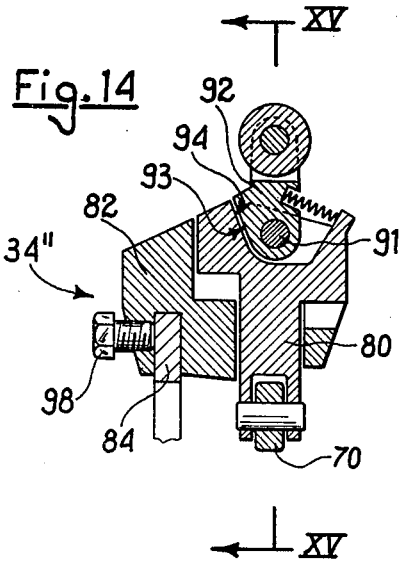
FIG. 14 is a cross-sectional view of the device of FIGS. 10 and 11, taken in the plane indicated at XIV—XIV in FIG. 15.
Figure 15:
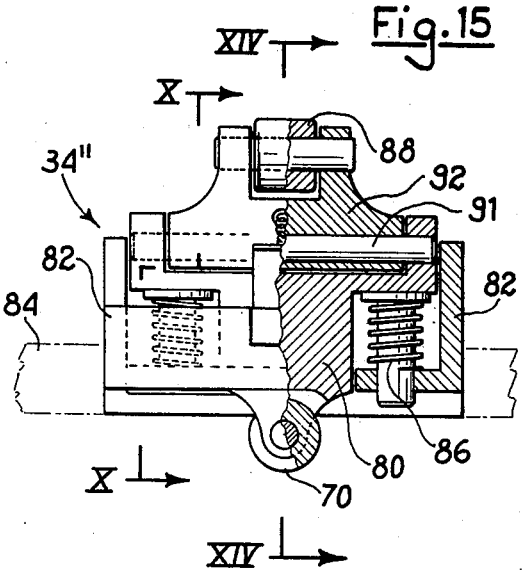
FIG. 15 is partly a front elevation and partly a sectional view taken in the plane indicated at XV—XV in FIG. 14 of same device.

The mechanical system 34' for controlling the level of a weft yarn guide bearer 30 (FIG. 12) has a structure similar to that of the above described system 34'', except that the system 34' has the gripper engaging roller 70 replaced by a tubular yarn guide 30, (or by an eyelet or other known yarn guide means) and its subassembly including parts 88 and 92, 94 is reversed relatively to that shown in FIGS. 10, 11 and 14, so that the yarn guide 30 will be lowered when the roller 88 engages the cam lobe 90' in direction R. A further description of such system 34' is therefore unnecessary.

It is to be understood that many changes are modifications may be made by those skilled in the art to the above described embodiments, without departing from the spirit and scope of this invention.

I claim:

1. A device for converting a shuttle loom, including a stationary supporting frame, a cyclically oscillatable slay mounted on the frame, slay oscillating means, a heald assembly cyclically opening sheds of the warp yarns, a weft yarn carrying shuttle carried by the slay and reciprocable thereon in a shuttle path extending parallel to the axis of oscillation of the slay, and shuttle boxes and pickers at opposite ends of the slay for receiving the shuttle and reciprocating the shuttle through open sheds, into a dummy shuttle loom without modification of the operation of the shuttle loom in oscillating the slay, in operating the heald assembly, and in reciprocating a shuttle through open sheds by operation of the shuttle boxes and pickers, said device comprising, in combination, a dummy shuttle reciprocable along said slay, having a transverse dimension substantially equal to that of said first-mentioned shuttle and braking surfaces engageable with said shuttle boxes, operatively cooperable with said shuttle boxes and pickers, formed with a longitudinal groove to receive weft yarn guides, and provided, adjacent each end, with releasable weft yarn grippers operable to grip a weft yarn as said dummy shuttle enters the shed; respective gripper actuators mounted on said slay adjacent each end thereof and operable to actuate said grippers to release a weft yarn as said dummy shuttle exits from the shed; respective gripper actuator control means mounted on said stationary supporting frame in the paths of oscillation of said gripper actuators and directly engageable with said gripper actuators, to actuate said grippers to release a weft yarn, responsive solely to oscillatory motion of said slay relative to said stationary frame and reciprocation of said dummy shuttle along said slay; respective mounting means mounting the gripper actuators adjacent each end of said slay, said mounting means being displaceable vertically relative to said slay; said control means comprising cam means operable to engage said mounting means during slay movement through a predetermined arc of its oscillatory motion in each direction; resilient means biasing each mounting means upwardly to an inoperative position of respective gripper actuator mounted thereon; a respective cam means engaging means articulated on each mounting means for operation by said cam means, to lower the associated mounting means, responsive to engagement of said cam means engaging means only when said slay is moving in one predetermined direction, said cam means engaging means, when engaged with said cam means during movement of said slay in the opposite direction, being displaced to an inoperative position.

2. A device according to claim 1, in which said gripper actuators are adjustably positioned along said slay in accordance with the desired width of the fabric to be woven within the limits defined by said shuttle boxes.

3. A device according to claim 1, in which said grippers have yarn gripping portions and have operating portions in advance of said yarn gripping portions in the direction of shuttle movement; said actuator control means being positioned at a distance outside the shed substantially equal to the distance between the yarn gripping portion and the operating portion of each gripper, to actuate said grippers to release a weft yarn substantially at the exit edge of the shed considered in the direction of shuttle movement.

4. A device according to claim 1, including respective second mounting means mounting yarn guides adjacent each end of said slay, said second mounting means being displaceably vertically relatively to said slay; respective second resilient means biasing each second mounting means upwardly to an inoperative position of the respective yarn guide; and a respective second cam means engaging means articulated on each second mounting means for operation by said cam means, to lower the associated second mounting means, responsive to engagement of said second cam means engaging means only when said slay is moving in the opposite predetermined direction, said second cam means engaging means, when engaged with said cam means during movement of said slay in said one predetermined direction, being displaced to an inoperative position.

* * * * *